United States Patent [19]

Sanchez

[11] 4,149,275

[45] Apr. 17, 1979

[54] VARIABLE LENGTH APPARATUS FOR HEMMED GARMENTS

[76] Inventor: Phyllis L. Sanchez, 980 College Dr., San Jose, Calif. 95128

[21] Appl. No.: 856,856

[22] Filed: Dec. 2, 1977

[51] Int. Cl.[2] ..... A41D 27/10

[52] U.S. Cl. ..... 2/269

[58] Field of Search ..... 2/269, 211, 243

[56] References Cited

U.S. PATENT DOCUMENTS

| | | | |
|---|---|---|---|
| 1,012,897 | 12/1911 | Nathan | 2/269 |
| 2,187,447 | 1/1940 | Chait et al. | 2/269 |
| 2,524,814 | 10/1950 | Leaf | 2/269 |

*Primary Examiner*—Werner H. Schroeder

*Assistant Examiner*—Doris L. Troutman

*Attorney, Agent, or Firm*—Phillips, Moore, Weissenberger, Lempio & Majestic

[57] ABSTRACT

This garment apparatus, intended primarily for conventional hemmed garments, provides very rapid, easily reversible, garment length adjustments. A set of fasteners, each fastener comprising a lower member attached adjacent the garment hem and at least one upper member spaced above the lower member and attached to the garment interior, is provided. For shortening the garment length, the garment is rolled inward and upward to the desired group of upper members, and the upper members are secured one to another. Decorative reinforcing elements can optionally be attached to the garment exterior.

4 Claims, 6 Drawing Figures

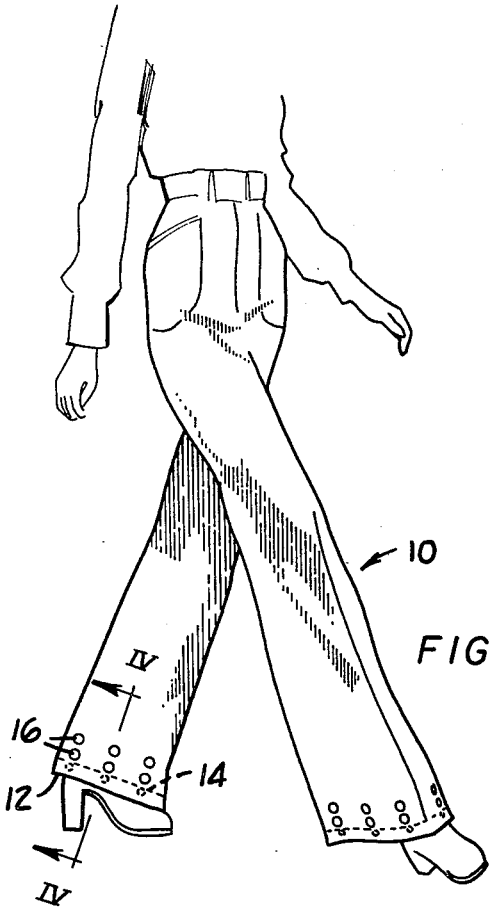
FIGURE 1.
FIGURE 2.
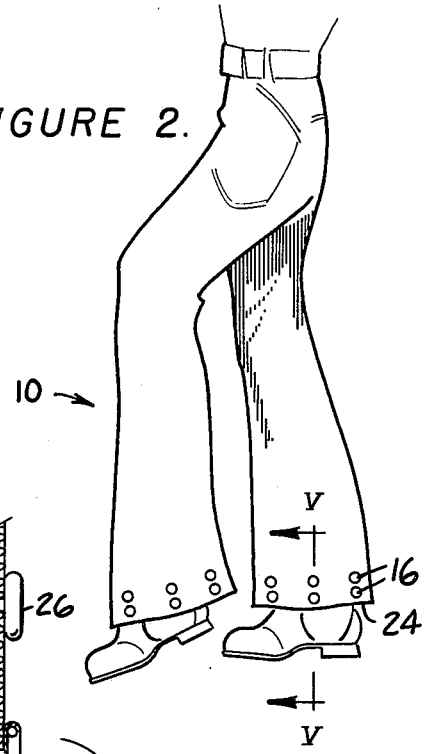
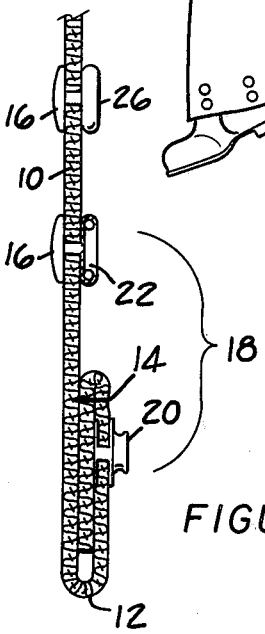
FIGURE 4.
FIGURE 3.
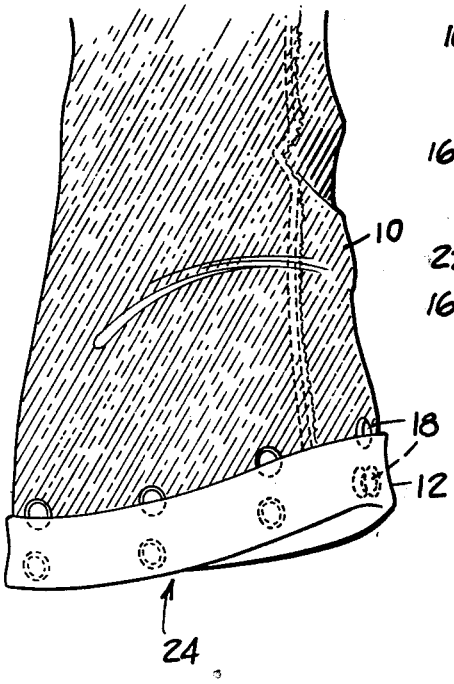
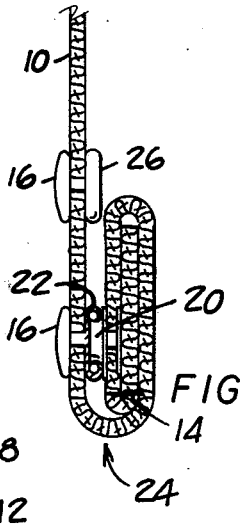
FIGURE 5.
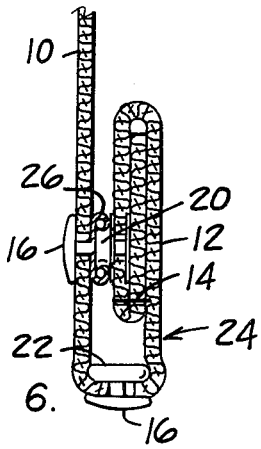
FIGURE 6.

VARIABLE LENGTH APPARATUS FOR HEMMED GARMENTS

BACKGROUND OF THE INVENTION

1. Field of the Invention

This invention relates to variable lengths for garments, and more particularly to the manner by which conventional hemmed garments can be temporarily shortened.

2. Description of the Prior Art

Prior variable garment length constructions fall broadly into three categories.

The first type of conventional garment construction involves a detachable garment piece, typically a cuff, which is affixed to the garment by means such as sewing. The cuff can have been rolled into an appropriate suitable to the wearer's physical dimensions prior to attachment. In order for the garment's length to be subsequently readjusted, the stitching holding the cuff to the garment must be moved, the cuff refolded, and the cuff then reattached.

The second type of conventional construction is a garment, usually a child's skirt or dress, which has been progressively folded, each fold being stitched in place. As the child grows the folds are sequentially unfurled by ripping out the stitching.

The third category broadly involves unhemmed garments. These unhemmed garments, usually skirts or dresses, must be constructed with sufficient additional fabric extending with respect to the longitudinal axis of the garment for a wide, floating hem to be subsequently formed. Such a construction is designed to permit variable garment lengths either for a single wearer or between several differently sized wearers. Such constructions incur increased fabric costs or unattractive garment bottom finishing, and are not adaptable to garments finished with small rolled hems.

Many garments are desirably constructed with a small, rolled hem which is stitched in place by hand or by machine. Particular examples of such small, rolled hem constructions are formal dresses, hemstitched by hand, and casual non-cuffed pants, hemstitched by machine.

None of the prior art variable hem constructions provide for temporary shortening of hemmed garments, nor do the prior art variable hem constructions readily adapt to conventional garments purchased off the rack. For example, temporary shortening of long, formal dresses would be desirable during the wearer's travel to social functions; entering and alighting automobiles is made quite awkward when wearing such a long dress. Alternatively, casual pants, when worn with low-heeled shoes suitable for extensive walking, are fashionable and practical at one length, while the same pants worn by the same person would desirably be somewhat longer when worn with higher heeled shoes or boots.

SUMMARY OF THE INVENTION

The present invention comprises a set of discrete fasteners disposed about the circumference of the hemmed garment. The fasteners are attached to the garment interior and each fastener comprises a lower member, adjacent the hemmed garment's original bottom edge, and an upper member corresponding with a respective each of the lower members. The upper and lower members are removably securable one to another, and define a vertical array of fastener members.

Each such vertical array can further include more than one upper member. Reinforcing elements for the upper members, which are preferably decorative as well as functional, are optionally attached to the garment exterior adjacent each upper member. Since the lower members are attached adjacent the garment original bottom edge, the lower members carry the garment into a new, shorter length when the lower members are secured to their corresponding upper members.

Accordingly, it is an object of the present invention to provide for variable garment lengths in an apparatus which can be readily adapted to conventional, purchased hemmed garments. It is a further object of this invention to provide an apparatus wherein the garment length can be shortened within a matter of moments.

It is a still further object of this invention that a garment shortened by the practice of the invention can be returned to its original hemmed length in a matter of moments.

These and other objects and advantages of the present invention will become more apparent by reference to the accompanying drawings and following description.

DESCRIPTION OF DRAWINGS

In the drawings:

FIG. 1 is a view of a hemmed garment incorporating a preferred embodiment of the present invention.

FIG. 2 is a side view of a garment as in FIG. 1, but with the garment shortened in accordance with the present invention.

FIG. 3 is an inside view of the garment as in FIG. 2.

FIG. 4 is a cross sectional view of the lower portion of FIG. 1, taken along line IV—IV.

FIG. 5 is a cross sectional view of the lower portion of FIG. 2, taken along line V—V.

FIG. 6 is a cross sectional view similar to FIG. 5, but with the garment shortened in accordance with the variable shortening length embodiment of the invention.

DESCRIPTION OF THE PREFERRED EMBODIMENT

Referring first to FIG. 1, there is illustrated the outside of garment 10, herein a pair of pants, an original bottom edge 12, a conventionally folded, stitched hem 14 and reinforcing elements 16, further described below.

Turning to FIG. 4, lower member 20 and corresponding upper member 22 together comprise a fastener shown generally as 18. It is to be understood that the present invention includes a single fastener 18 for a limited shortening of part of a garment's original bottom edge. However, use of more than one fastener 18 is herein illustrated in FIGS. 1, 2 and 3, as the best mode of the present invention. In the present invention it is necessary that each fastener 18 be separate and distinct, or discrete, from the other fasteners in the set. The number of fasteners 18 in the set of fasteners 18 is chosen as convenient for the particular garment's circumference. As seen in FIG. 4, lower member 20 and upper member 22 comprising fastener 18 define a vertical array, so that upper member 22 is in a spaced relationship with respect to lower member 20. Both lower member 20 and upper member 22 are attached to the garment 10 interior, as by conventional means such as sewing, and lower member 20 is adjacent the original bottom edge 12 of garment 10.

Turning to FIGS. 3 and 5 garment 10 is easily and rapidly shortened in length by securing each lower element 20 to each corresponding upper element 22, so that a new bottom edge, indicated by arrow 24, is formed and the garment is shortened.

Further, the invention can be practiced as illustrated in FIG. 6 wherein an additional upper member 26 is in the vertical array defining fastener 18. Additional upper members 26 enable variable shortening in length of garment 10.

Reinforcing elements 16, provide increased strengthening for upper members 22, 26 to insure that during the life of the garment upper members 22, 26 remain firmly attached to the garment. Reinforcing elements 16 are attached to the garment exterior and are adjacent each upper member 22, 24. Reinforcing elements 16 preferably also provide means for incorporating decorative additions to garment 10. Reinforcing elements 16 also provide a means for masking the stitches, or other attachment means, by which upper members 22, 26 are attached to garment 10. For example, reenforcing elements 16 may be pearlized buttons.

Sufficient reinforcing and/or masking for lower members 20 is inherently provided by the fabric layers of the conventional garment hem 14, as best illustrated in FIG. 4.

In the best mode contemplated for the present invention, fasteners 18 are snaps, i.e. lower members 20 and upper members 22, 26 are corresponding male and female snap members. For example, when all lower member 20 comprise male members, the upper members 22, 26, would all be female snap members.

Finally, it is to be understood that the vertical array comprising fastener 18 requires a spaced relationship between lower members 20 and upper members 22, 26. This spaced relationship need not be the same for each and every fastener 18. The spaced relationship can vary so long as the particular group of upper members 22, or the group of upper members 26, defines a substantially transverse plane with respect to the garment's longitudinal axis.

It is to be understood that the foregoing description is merely illustrative of a preferred embodiment of the invention and that the scope of the invention is not to be limited thereto but is to be determined by the scope of the appended claims.

What is claimed is:

1. An apparatus for varying the length of a hemmed garment comprising: a set of discrete fasteners disposed about the circumference of the garment and attached interior thereto, each of the fasteners comprising a lower member attached to the garment upon the hem and adjacent the garment original bottom edge and a plurality of upper members, each said upper member in a spaced vertical relationship from a respective said lower member to form a vertical array, said lower members removably securable with said upper members, whereupon securing each lower member to the respective upper member in each vertical array shortens the garment length, while removing each lower member from secured contact with the respective each upper member returns the garment to its original length; and a plurality of discrete decorative elements attached exterior the garment and opposite each upper member, the decorative elements reinforcing the upper member attachment to the garment.

2. The apparatus as in claim 1 wherein: the garment is pants, both pants leg bottoms together comprising the garment original bottom edge.

3. The apparatus as in claim 1 wherein: the fasteners are snaps, the lower members being male snap members and the upper members being female snap members.

4. The apparatus as in claim 3 wherein: the decorative elements are buttons.

* * * * *